US007434531B1

(12) United States Patent
Zsido et al.

(10) Patent No.: US 7,434,531 B1
(45) Date of Patent: Oct. 14, 2008

(54) DEVICE FOR ADJUSTING BOAT WAKE

(75) Inventors: Joseph Zsido, Benton, IL (US); Thomas C. Earl, Jr., Cape Carol, FL (US)

(73) Assignee: Pivotal Designs Inc., Benton, IL (US)

( * ) Notice: Subject to any disclaimer, the term of this patent is extended or adjusted under 35 U.S.C. 154(b) by 0 days.

(21) Appl. No.: 11/799,866

(22) Filed: May 3, 2007

(51) Int. Cl.
*B63B 1/22* (2006.01)

(52) U.S. Cl. ..... 114/284; 114/285

(58) Field of Classification Search ..... 114/285–287, 114/284; 405/79
See application file for complete search history.

(56) References Cited

U.S. PATENT DOCUMENTS 3,117,547 A * 1/1964 Cohen et al. ..... 114/283
3,200,782 A * 8/1965 Walden et al. ..... 114/285
3,577,948 A * 5/1971 Frey ..... 114/286
6,941,884 B2 * 9/2005 Moore ..... 114/284

* cited by examiner

*Primary Examiner*—Ed Swinehart
(74) *Attorney, Agent, or Firm*—Wood, Phillips, Katz, Clark & Mortimer

(57) ABSTRACT

A boat with a controllable wake, including a boat hull with a propulsion system. A wake controlling device includes first and second plates with a bottom surface which is convexly curved between their forward and rear ends, and first and second mounts secured to the port and starboard sides, respectively, of the boat transom and securing the forward ends of the plates for pivoting about axes which are behind the boat transom and generally lie parallel to the plane of the aft boat bottom adjacent the first and second mounts. Plate controls extend between the transom and the plates to adjustably pivot the plates relative to the mounts. A plurality of generally triangular fins extend from the plates at substantially right angles to the plate bottom surfaces and extend at substantially right angles from the axes. Side plates are on the lateral edges of the first and second plates.

2 Claims, 2 Drawing Sheets

DEVICE FOR ADJUSTING BOAT WAKE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward boats for skiing and wake boarding, and particularly toward controlling the wake generated by, and enhancing the maneuvering of, boats.

BACKGROUND OF THE INVENTION AND TECHNICAL PROBLEMS POSED BY THE PRIOR ART

Power boating is a popular recreation enjoyed by many people of all walks of life. It is, of course, desirable to provide power boats which may be comfortably and safely operated by all potential users. Therefore, a variety of devices have been used to properly position the boat as it moves through the water, including a variety of trim tabs or plates which may be adjusted to ensure that when the boat moves through the water it will neither ride up too high to cause instability of the boat nor ride too low in the water to cause excessive drag forces on the boat.

Devices which have been used for such purposes have been disclosed in U.S. Pat. Nos. 2,816,521, 3,530,816, 3,601,078, 3,678,874, 1,779,075, 3,577,984, 3,718,642, 3,678,874, German Patent 357644, French Patents 458807 and 2250663 and Australian Patents 264064 and 50740 which, for the most part, disclose flaps and tabs which are satisfactory only to a limited extent in trimming a boat as the boat is under way. More recently, U.S. Pat. No. 4,909,175 has attempted to improve upon this trim control of the boat by a structure including a trim plate which is mounted to the boat bottom at a point forward of the transom or aft end of the boat in cantilever fashion on the bottom of a boat. That plate, when adjusted, provides for trimming of the boat when the boat is underway and moves over the water to provide stability and efficient operation.

In addition to recreational use of boats to move over bodies of water, power boats are also sometimes used with water sports, which are popular recreation, exercise and, in some cases, competitive activities which are enjoyed virtually anywhere which has reasonably warm weather and a body of water. Among the most popular of water sports using a boat are water skiing and, to a growing degree, wake boarding. Wake boarders ride a device known as a wake board while being pulled by a tow line or rope behind a suitable power boat (in the same manner that a water skier is pulled behind a boat). Both wake boarders and water skiers will often maneuver laterally across the wake produced by the moving boat in a slalom-like fashion, with the passage of the wake board or skis over the wake lifting the participant into the air, allowing the wake boarder or skier the opportunity, if desired, to perform various flips or other tricks prior to landing back onto the surface of the water.

Obviously, the ride of the wake boarder or skier will in large part be dependent on the level of the wake of the boat being pulled. Moreover, different level wakes may be desirable for different types of tricks. Thus, depending on the combination of tricks which a wake boarder or water skier may desire to perform, varying wake levels may be desirable during a single ride.

Some adjustments to the wake level of a boat having an outboard motor may be accomplished by changing the orientation of the propeller within the water. However, such adjustments are somewhat limited and not easily obtainable with boats that include inboard motors.

A variety of devices have heretofore also been provided to assist in creating a desired wake in such uses. Some devices change the trim of the boat through the provision of ballast in the boat, such as pumping water into or out of bladders to cause the rear of the boat to sit lower or higher in the water, or to simply add weight such as concrete blocks to the boat. However, such devices may only change the boat trim slowly, and therefore quick changes to the wake level may not be quickly accomplished. This may not only generally frustrate the wake boarder or skier, but also may make a quick succession of different tricks requiring different wake levels impossible. Further, devices of this type may be dangerous if not used correctly as they may cause the boat to sit too low in the water.

U.S. Pat. No. 5,860,384 discloses a hydrofoil which is pivotably secured to the transom of a boat, and which may be pivoted to adjust the wake provided by the boat. However, boats using this device and others such as disclosed, for example, in U.S. Pat. No. 5,549,071 may not be ideally maneuvered.

The present invention is directed toward overcoming one or more of the problems set forth above.

SUMMARY OF THE INVENTION

In one aspect of the present invention, a boat with a selectively controllable wake when propelled through water is provided, including a boat hull, a propulsion system for propelling the boat hull over a body of water, and a device for controllably adjusting the wake of a boat for skiers and wake boarders pulled by the boat. The boat hull has a longitudinal center line between port and starboard sides, a transom at the aft end, and a hull bottom extending substantially continuously to the transom. The wake controlling device includes first and second plates with a bottom surface which is convexly curved between the forward and rear ends, and first and second mounts, secured to the port and starboard sides, respectively, of the boat transom and securing the forward ends of the plates for pivoting about axes which are behind the boat transom and generally lie parallel to the plane of the aft boat bottom adjacent the first and second mounts. First and second plate controls extend between the boat transom and the first and second plates, respectively, and are selectively adjustable to adjustably pivot the first and second plates relative to the first and second mounts, respectively.

In one form of this aspect of the present invention, a plurality of generally triangular fins extend from the first and second plates at substantially right angles to the plate bottom surfaces and extend at substantially right angles from the first and second axes.

In another form of this aspect of the present invention, side plates are on the lateral edges of the first and second plates.

In still another form of this aspect of the present invention, the first and second mounts each include an angled plate including a mounting portion securable to the boat transom and a base plate having a bottom surface substantially aligned with the bottom hull surface at the aft end of the boat, wherein the pivot axes are defined on the respective base plates spaced aft from the mounting portion. In a further form, the transom is curved and the angled plate mounting portion is curved to substantially match the curve of the transom, and the hull bottom and transom intersect at a first angle, the mounting portion and the base plate of each angled plate intersect at a second angle, and the first and second angles are supplementary. In a further form, the forward end of the bottom surfaces of the first and second plates in a first position are substantially aligned with the bottom surfaces of the base plates of the first and second mounts, respectively and, in a still further form, the plate controls are selectively adjustable to pivot the first and second plates down from the first position to increase the wake of the boat.

In yet another form of this aspect of the present invention, the plate controls are each cylinders having selectively adjustable lengths.

In yet another form, the transom extends generally transverse and forward on opposite sides of the longitudinal center line.

In another aspect of the present invention, a boat with a selectively controllable wake when propelled through water is provided, including a boat hull, a propulsion system for propelling the boat hull over a body of water, and a device for controllably adjusting the wake of a boat for skiers and wake boarders pulled by the boat. The boat hull has a longitudinal center line between port and starboard sides, a transom at the aft end, and a hull bottom extending substantially continuously to the transom. The wake controlling device includes first and second plates with a bottom surface which is convexly curved between the forward and rear ends, and first and second mounts, secured to the port and starboard sides, respectively, of the boat transom and securing the forward ends of the plates for pivoting about axes which are behind the boat transom and generally lie parallel to the plane of the aft boat bottom adjacent the first and second mount. The first and second mounts each have an angled plate including a mounting portion securable to the boat transom and a base plate having a bottom surface substantially aligned with the bottom hull surface at the aft end of the boat, wherein the pivot axes are defined on the respective base plates spaced aft from the mounting portion. Further, a plurality of generally triangular fins extend from the first and second plates at substantially right angles to the plate bottom surfaces and extend at substantially right angles from the first and second axes, and side plates are on the lateral edges of the first and second plates. First and second plate controls extend between the boat transom and the first and second plates, respectively, and are selectively adjustable to adjustably pivot the first and second plates relative to the first and second mounts, respectively. The forward end of the bottom surfaces of the first and second plates in a first position are substantially aligned with the bottom surfaces of the base plates of the first and second mounts, respectively, and the plate controls are selectively adjustable to pivot the first and second plates down from the first position to increase the wake of the boat.

In one form of this aspect of the present invention, the transom is curved and the angled plate mounting portion is curved to substantially match the curve of the transom, and the hull bottom and transom intersect at a first angle, the mounting portion and the base plate of each angled plate intersect at a second angle, and the first and second angles are supplementary.

In a further form of this aspect of the invention, the transom extends generally transverse and forward on opposite sides of the longitudinal center line.

In still another aspect of the present invention, a device is provided for adjusting the wake of a boat, including a first plate and a second plate, each convexly curved between its forward and rear ends, first and second mounts for the plates port and starboard, respectively, relative to the longitudinal boat centerline, and first and second plate controls securable between a boat transom and the first and second plates, respectively. The first mount is adapted to pivotally secure the forward end of the first plate to the bottom aft end of the boat for pivoting about a first axis, with the first axis being behind the aft end of the boat and generally lying in the plane of the boat bottom at the aft end. The second mount adapted to pivotally secure the forward end of the second plate to the bottom aft end of the boat for pivoting about a second axis, with the second axis being behind the aft end of the boat and generally lying in the plane of the boat bottom at the aft end, wherein the first and second mounts are port and starboard, respectively, relative to the longitudinal boat centerline. The plate controls are selectively adjustable to adjustably position the first and second plates relative to the first and second mounts, respectively.

In one form of this aspect of the present invention, a plurality of generally triangular fins extend from the first and second plates at substantially right angles to the plate bottom surfaces and extend at substantially right angles from the first and second axes.

In another form of this aspect of the present invention, side plates are on the lateral edges of the first and second plates.

In still another form of this aspect of the present invention, the first and second mounts each include an angled plate including a mounting portion securable to the boat transom and a base plate having a bottom surface substantially alignable with the bottom hull surface at the aft end of the boat, wherein the pivot axes are defined on the respective base plates spaced aft from the mounting portion.

DETAILED DESCRIPTION OF THE INVENTION

The present invention relates to a device 10 usable with a powered boat to selectively control the wake of the boat as it is propelled through the water.

Figure 1:
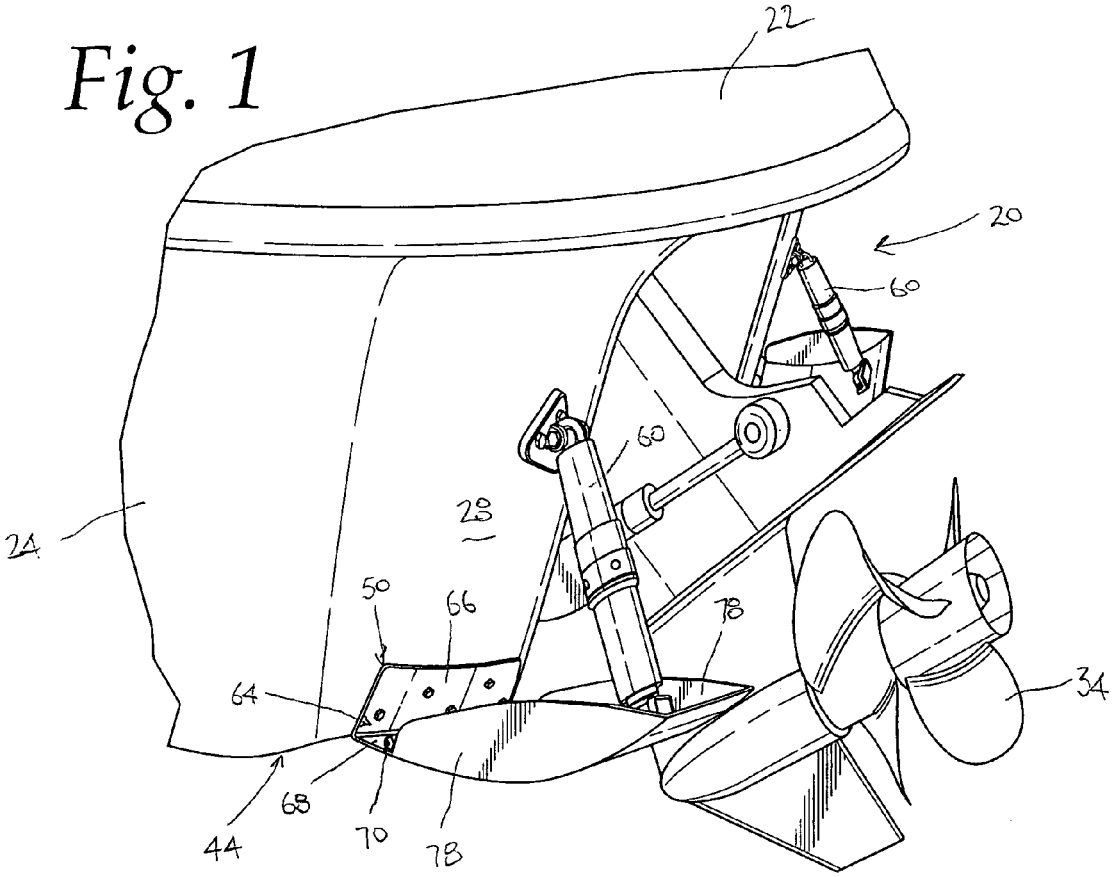
FIG. 1 is a perspective view of a boat aft incorporating the present invention.
Figure 2:
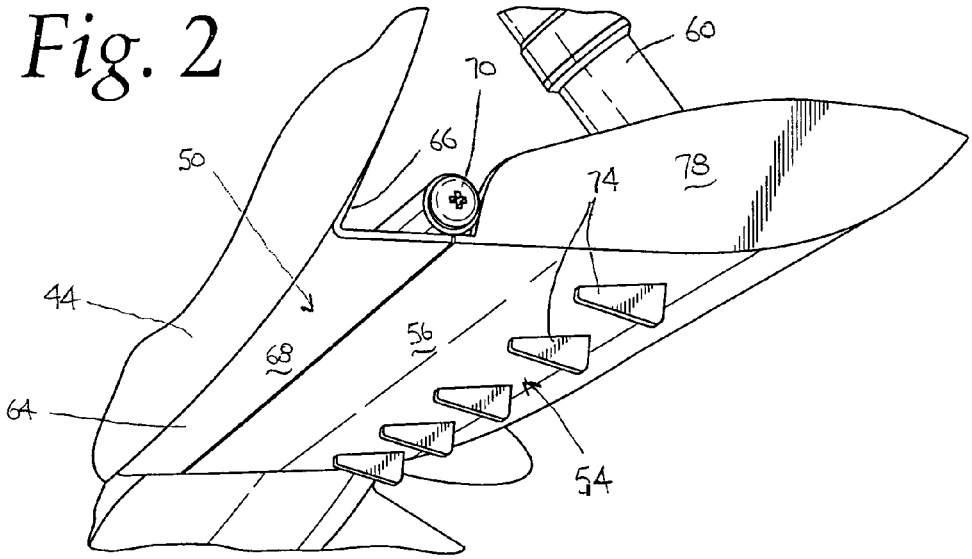
FIG. 2 is a perspective view from below of one wake adjusting plate from FIG. 1.
Figure 3:
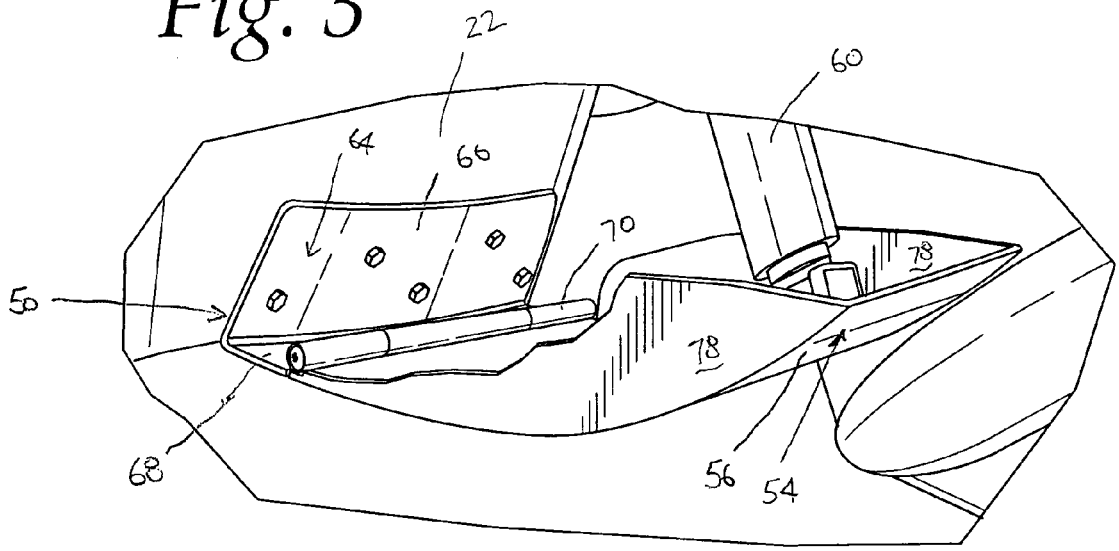
FIG. 3 is a perspective view from below of the plate of FIG. 2, with one side plate partially broken away.

More specifically, as illustrated in FIG. 1, the aft end 20 of the hull 22 of a boat 24 includes a transom 28. Located at the longitudinal centerline 30 of the boat 24 is the boat drive or propulsion system: a motor driven propellor 34. It should be appreciated, however, that the present invention could also advantageously be used with different drives, including inboard and outboard motors, and multiple drives centered around, but not necessarily located on, the boat longitudinal centerline 30 (e.g., with one drive on the port side 40 and one drive on the starboard side 42).

In accordance with the present invention, the bottom 44 of the hull 22 in the aft end 20 of the boat 24 extends substantially continuously to the transom 28. That is, particularly at the portion of the transom 28 at which the wake control devices 10 are secured (as described below), the hull bottom 44 is an extension of the forward surface of the hull bottom 44 and defines the surface of the hull bottom 44 which rides on the water as the boat 24 is propelled through the water.

Figure 4:
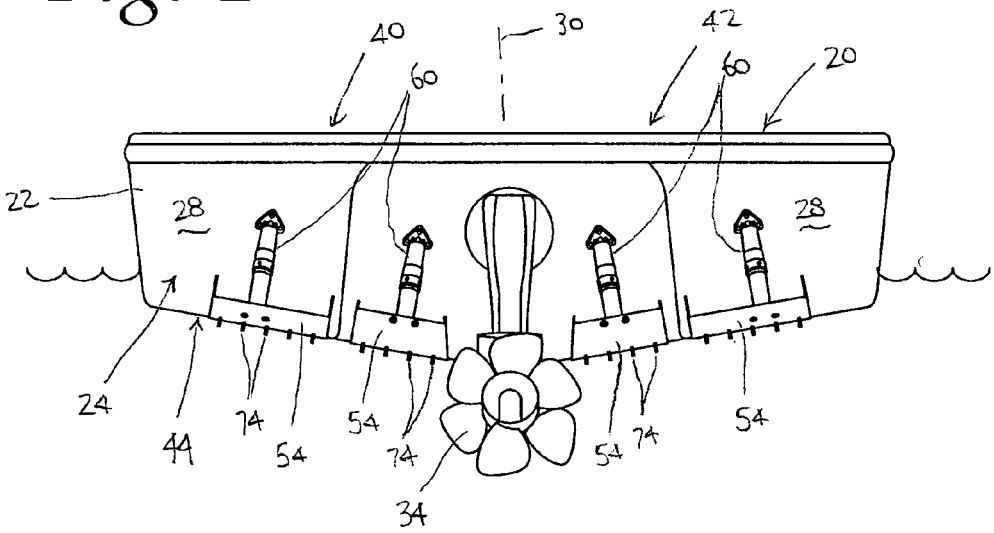
FIG. 4 is a rear view of a boat aft incorporating the present invention.

Wake control devices 10 are preferably evenly located at opposite sides of the longitudinal centerline 30. In the FIG. 1 illustration, two such devices 10 are provided, whereas in the FIG. 4 embodiment four such devices 10 are provided. In either case, the devices 10 are balances around the longitudinal centerline 30 of the boat 24.

Each wake control device 10 includes a mount 50 which may be advantageously secured to the boat transom 28, a plate 54 with a bottom surface 56 which is convexly curved between its forward and rear ends and pivotally secured to the mount 50 at its forward end, and a cylinder 60 between the transom 28 and the plate 54 which is selectively adjustable to control the pivotal position of the plate 54 relative to the mount 50.

Each mount 50 is an angled plate 64 which includes a mounting portion 66 and a base plate 68. The mounting portion 66 may be advantageously curved to substantially match the any curve of the transom 28 to which it is to be secured, with the angled portion of the plate 64 similarly curved if necessary to match any curve at the bottom of the transom 28. The base plate 68 has a bottom surface substantially aligned with the bottom hull surface 44 at the aft end of the boat 24 so as to together define a substantially smooth continuous bottom surface at that location.

A suitable hinge 70 between the mount 50 and the plate 54 is provided at the rear or aft end of the mount base plate 68, and defines a pivot axis for the base plate 68 which is spaced aft from the mounting portion 66 and generally lies parallel to the plane of the bottom surface 44 of the boat 24 adjacent the mount 50.

Where the mount 50 is secured to the transom 28, the hull bottom surface 44 and transom 28 intersect at a first angle, and the mount 50 is advantageously configured so that the mounting portion 66 and the base plate 68 intersect at a second angle, with the first and second angles being supplementary. It should therefore be appreciated that the bottom hull surface 44 and the adjacent mount base plate 68 will present a substantially straight, flat bottom surface.

It should further be appreciated that a linear workable hinge 70 may be provided notwithstanding any curvature of the transom 28 while also providing the desired adjacent bottom surface which is substantially continuous with the bottom surface 44 at the aft end of the hull 22. Further, in addition to presenting a curved surface, the transom 28 may also commonly extend generally not only transverse but also forward on opposite sides of the longitudinal centerline 30. It should thus also be appreciated that the mount base plate 68 may be suitably configured to extend laterally relative to the boat centerline 30 notwithstanding the forward angle of the transom 28 to which the mount 50 must be secured.

The plate 54 of each wake control device 10 further may advantageously include generally triangular fins 74 extending at substantially right angles to the plate bottom surfaces and extending at substantially right angles from pivot axis defined by the hinge 70. The fins 74 have been found to facilitate advantageous flow performance of the plate 54 through the water.

The convex curve of bottom surface of the plate 54 may vary within the scope of the present invention. However, it has been found that a plate which is about 13.5 inches in a straight line from the front edge to the rear edge with multiple curvatures may be most advantageously used. Measured along that straight line, the front edge of the plate 54 may be substantially flat for about 4.0 inches, then with a first convex curve of a radius of about 21.7 inches for about 1.7 inches, with a second convex curve of a radius of about 14.3 inches for about 3.5 inches, and a final convex curve of a radius of about 10.7 inches extending for about 4.3 inches to the rear edge of the plate 54.

Side plates 78 are also advantageously provided on the lateral edges of plate 54 to reinforce the plate 54 and help in maintaining the desired curved configuration. Still further, the forward end of the plate bottom surface 66 in a first position is substantially aligned with the bottom surface of the mount base plate 68, and the plate 54 can be selectively pivoted down from that first position around the hinge 70 to increase the wake of the boat 24.

The pivotal position of each plate 54 is suitably controlled, advantageously by a control unit which can be accessed by the person steering the boat 24, as by controlling the length of the cylinder 60 which is mounted at one end to the transom 28 and at the other end to the plate 54. By selectively controlling the condition of each cylinder 60, the boat operator may selectively adjust the boat wake in order to accommodate the wishes of the wake boarder or skier being pulled by the boat 24.

Of course, it should be recalled that more than one of the above described wake control devices 10 are provided for use with a boat 24, balanced on opposite sides of the boat longitudinal centerline 30. Two such devices 10 are provided in the FIG. 1 embodiment, and four such devices are provided in the FIG. 4 embodiment. Other combinations of devices 10 could also be provided, including, for example, three such devices 10 with one centered on the longitudinal centerline 30 (e.g., with a dual inboard boat propulsion system in which there is no propulsion structure at the center of the transom 28), and the other two devices 10 balanced on opposite sides of the centerline 30.

It should be appreciated that boats having the wake control devices of the present invention may be advantageously used for the enjoyment of wake boarders and skiers alike. Further, it should be appreciated that the present invention may be provided without requiring that the standard hull of any boat design be changed in a way which may disadvantageously affect performance of the boat when wake adjustment is not desired. Still further, it should be appreciated that the present invention may be readily accommodated for use with most all hull designs, including various straight, tilted, and/or curved transom designs, and that the wake control devices of the present invention may be readily installed not only in new boats but also retrofitted for boats already in use.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A boat with a selectively controllable wake when propelled through water, comprising:

a boat hull having a longitudinal center line between port and starboard sides, a transom at the aft end, and a hull bottom extending substantially continuously to the transom;

a propulsion system for propelling the boat hull over a body of water; and a device for controllably adjusting the wake of a boat for skiers and wake boarders pulled by the boat, including a first plate and a second plate, each plate having a forward end and a rear end with a bottom surface which is convexly curved between said forward and rear ends, a first mount secured to the port side of the boat transom and securing the forward end of the first plate for pivoting about a first axis which is behind the boat transom and generally lies parallel to the plane of the aft boat bottom adjacent the first mount, a second mount secured to the starboard side of the boat transom and securing the forward end of the second plate for pivoting about a second axis which is behind the boat transom and generally lies parallel to the plane of the aft boat bottom adjacent the second mount, and first and second plate controls between the boat transom and the first and second plates, respectively, said plate controls being selectively adjustable to adjustably pivot the first and second plates relative to the first and second mounts, respectively;

wherein said first and second mounts each comprise an angled plate including a mounting portion securable to the boat transom and a base plate having a bottom surface substantially aligned with the bottom hull surface at the aft end of the boat, wherein said pivot axes are defined on the respective base plates spaced aft from the mounting portion, said transom is curved, and said angled plate mounting portion is curved to substantially match the curve of the transom, and said hull bottom and transom intersect at a first angle, said mounting portion and said base plate of each angled plate intersect at a second angle, and said first and second angles are supplementary.

2. A boat with a selectively controllable wake when propelled through water, comprising:

a boat hull having a longitudinal center line between port and starboard sides, a transom at the aft end, and a hull bottom extending substantially continuously to the transom;

a propulsion system for propelling the boat hull over a body of water; and a device for controllably adjusting the wake of a boat for skiers and wake boarders pulled by the boat, including a first plate and a second plate, each plate having a forward end and a rear end with a bottom surface which is convexly curved between said forward and rear ends, a first mount secured to the port side of the boat transom and securing the forward end of the first plate for pivoting about a first axis which is behind the boat transom and generally lies parallel to the plane of the aft boat bottom adjacent the first mount, and a second mount secured to the starboard side of the boat transom and securing the forward end of the second plate for pivoting about a second axis which is behind the boat transom and generally lies parallel to the plane of the aft boat bottom adjacent the second mount, wherein said first and second mounts each comprise an angled plate including a mounting portion securable to the boat transom and a base plate having a bottom surface substantially aligned with the bottom hull surface at the aft end of the boat, wherein said pivot axes are defined on the respective base plates spaced aft from the mounting portion first and second plate controls between the boat transom and the first and second plates, respectively, said plate controls being selectively adjustable to adjustably pivot the first and second plates relative to the first and second mounts, respectively, a plurality of generally-triangular fins extending from said first and second plates at substantially right angles to the plate bottom surfaces and extending at substantially right angles from said first and second axes, side plates on the lateral edges of the first and second plates, and wherein the forward end of the bottom surfaces of the first and second plates in a first position are substantially aligned with the bottom surfaces of the base plates of the first and second mounts, respectively, and said plate controls are selectively adjustable to pivot said first and second plates down from said first position to increase the wake of the boat;

wherein said transom is curved, and said angled plate mounting portion is curved to substantially match the curve of the transom, and said hull bottom and transom intersect at a first angle, said mounting portion and said base plate of each angled plate intersect at a second angle, and said first and second angles are supplementary.

* * * * *